US007682217B2

(12) United States Patent
Hsu

(10) Patent No.: US 7,682,217 B2
(45) Date of Patent: Mar. 23, 2010

(54) INTERNAL ROCKING STRUCTURE IN A PUPPET EYEBALL

(75) Inventor: Ming-Tay Hsu, Taoyuan Hsien (TW)

(73) Assignee: Foluck International Co., Ltd., Taoyuan (TW)

( * ) Notice: Subject to any disclaimer, the term of this patent is extended or adjusted under 35 U.S.C. 154(b) by 245 days.

(21) Appl. No.: 11/856,331

(22) Filed: Sep. 17, 2007

(65) Prior Publication Data

US 2009/0017720 A1 Jan. 15, 2009

(30) Foreign Application Priority Data

Jul. 11, 2007 (TW) ..... 96211268 U

(51) Int. Cl.
*A63H 3/38* (2006.01)

(52) U.S. Cl. ..... 446/343; 446/341; 446/183; 446/379; 446/320

(58) Field of Classification Search ..... 446/389, 446/392, 337–345, 379, 183, 394, 320
See application file for complete search history.

(56) References Cited

U.S. PATENT DOCUMENTS 494,410 A * 3/1893 Carpenter ..... 446/183
2,668,394 A * 2/1954 Auzin ..... 446/183
2,854,788 A * 10/1958 Baggott ..... 446/183
2,960,794 A * 11/1960 Johns ..... 446/183
3,451,160 A * 6/1969 Ryan et al. ..... 446/183
4,580,991 A * 4/1986 Renger et al. ..... 446/320
4,828,526 A * 5/1989 Schneider et al. ..... 446/183
5,205,773 A * 4/1993 Koepcke et al. ..... 446/183
5,334,079 A * 8/1994 Gentile et al. ..... 446/486
6,786,794 B2 * 9/2004 Bae ..... 446/392

* cited by examiner

*Primary Examiner*—Gene Kim
*Assistant Examiner*—Urszula M Cegielnik
(74) *Attorney, Agent, or Firm*—Chun-Ming Shih

(57) ABSTRACT

An internal rocking structure applied in eyeball of the puppet includes an outer casing made of a transparent material, an inner casing, and an elastic member; the inner casing being connected to the elastic member, which is connected to a bottom of the outer casing; a pattern of an eyeball being printed on where appropriately on the inner casing; upon shaking the rocking structure, the elastic member maintaining the inner casing in a rocking status for a given time to deliver amusing effects of a rocking eyeball and significantly increase bizarrely lovable effects when applied in a puppet or doll.

10 Claims, 8 Drawing Sheets

INTERNAL ROCKING STRUCTURE IN A PUPPET EYEBALL

BACKGROUND OF THE INVENTION (a) Field of the Invention

The present invention is related to an internal rocking structure applied in a puppet eyeball, and more particularly, to a dynamic design art of demonstrating bizarrely lovable rocking eyeball effects.

(b) Description of the Prior Art

To cope with ever increasing pressure and stress people today have to deal with, many office toys are generally available in the market and they are bizarrely lovable to help release stress. Among various forms of office toys, puppets usually are squeezed to produce funny visual effects, and designs of eyeballs for those puppets are particularly amusing to attract consumers, solicit desire of consumers to buy, and increase funs of playing with them.

SUMMARY OF THE INVENTION

The primary purpose of the present invention is to provide an internal rocking structure that can be applied in eyeballs of a puppet that provides funny and amusing effects to expressions delivered by a pair of rocking eyeballs installed in any office toy. To achieve the purpose, the structure is comprised of an outer casing, an inner casing, and an elastic member. Wherein, the outer casing is made of a transparent material; the inner casing is connected to the elastic member; and the elastic member is connected to a bottom of the outer casing. A pattern of eyeball is printed at where appropriately on the inner casing. Accordingly, upon shaking the rocking structure, the elastic member is capable of maintaining the inner casing in a rocking status for a considerable long time to deliver bizarrely lovable effects of a pair of rocking eyeballs and significantly increase the funny and amusing results when the rocking structure is applied in a puppet or doll.

Whereas the inner casing and the elastic member are placed in the outer casing, they are protected by the outer casing to prevent the elastic member from getting loosened up and deformed due to frequently pull and drag, so to effectively extend service life of the eyeball. Furthermore, the pattern of eyeball printed on the inner casing is also protected by the outer casing from tear and wear.

Ingenuous design significantly upgrade the amusement value of the present invention since the rocking of the eyeballs takes place in the outer casing to take consumers by surprise and the rocking statues is maintained in the internal structure that is untouchable to invite curiosity from consumers to quest.

DETAILED DESCRIPTION OF THE PREFERRED EMBODIMENTS

Figure 1:
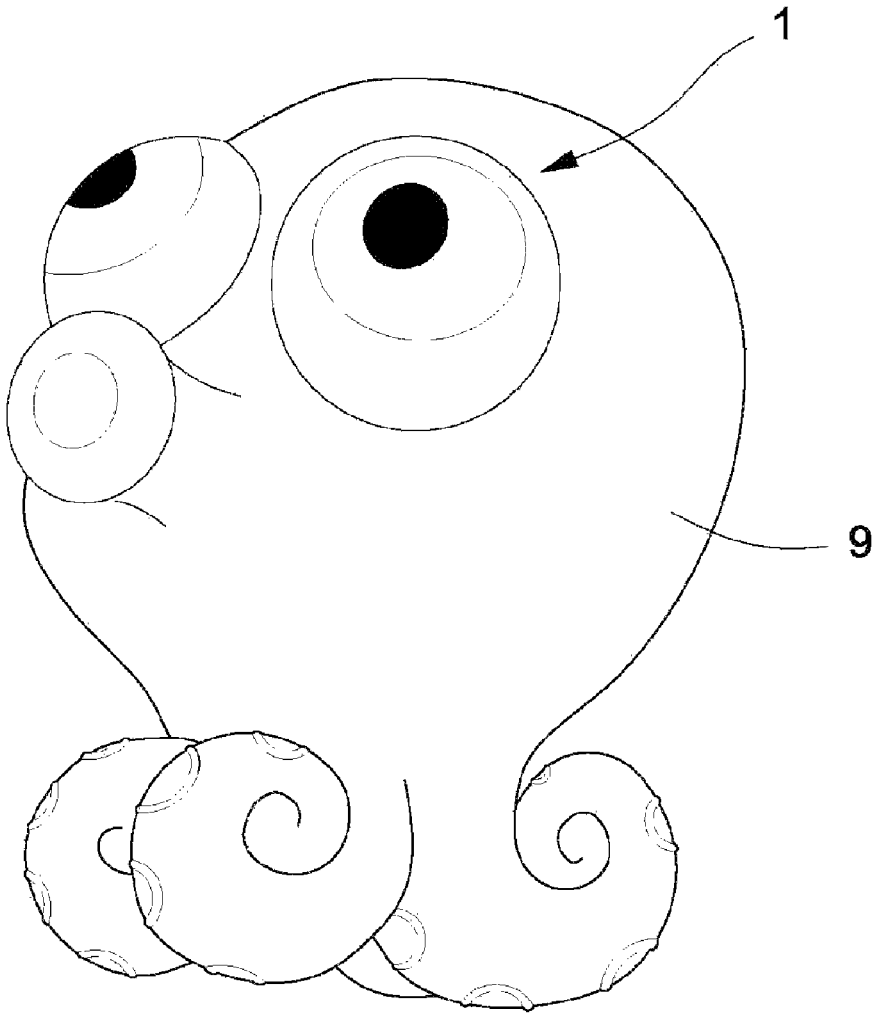
FIG. 1 is a perspective view of the present invention.

Referring to FIG. 1, an internal rocking structure 1 for an eyeball of a puppet can be applied in an eye of any type of puppet, and a preferred embodiment of an octopus puppet 9 is illustrated for the present invention, but the preferred embodiment is not restrictive to the present invention.

Figure 2:
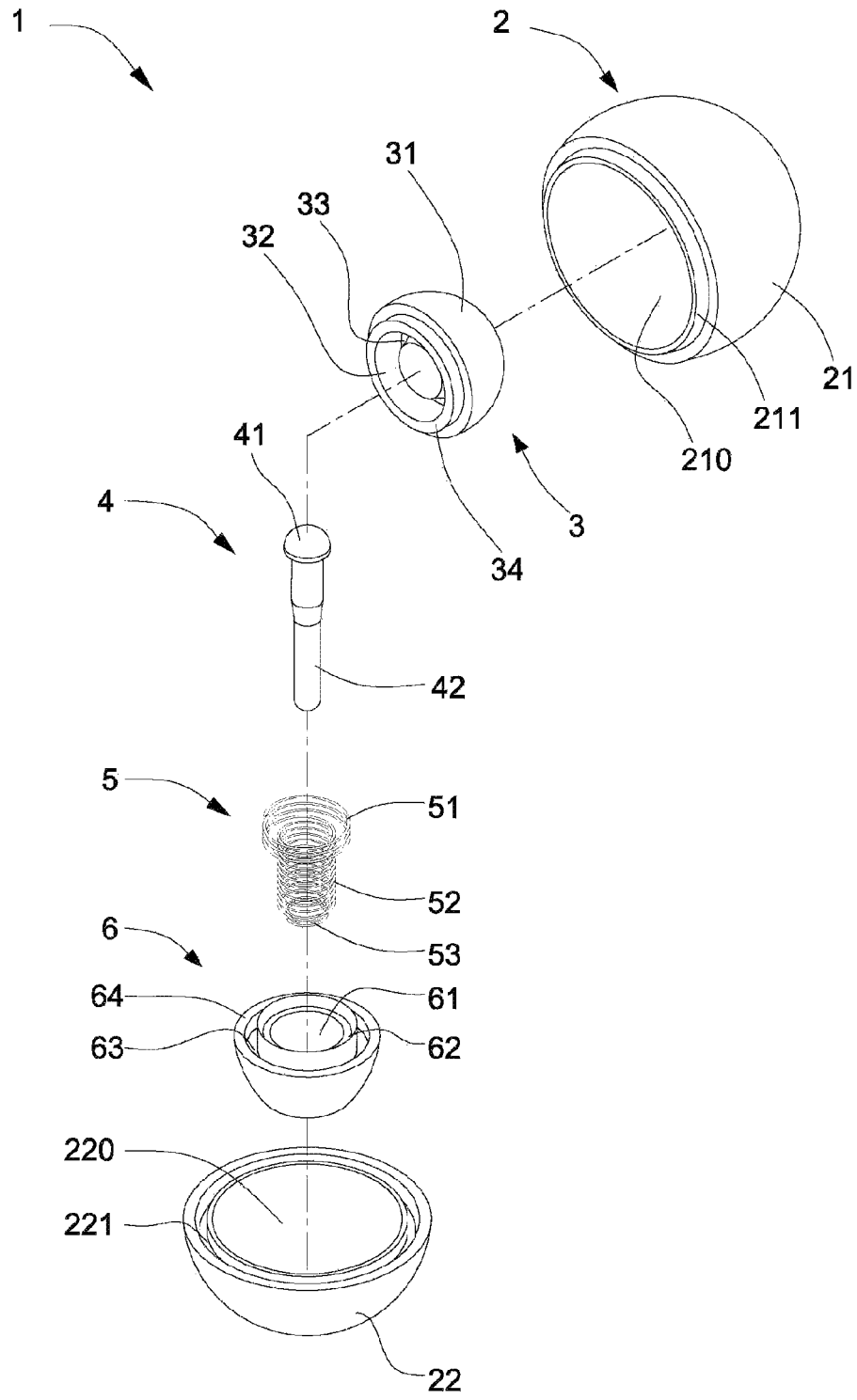
FIG. 2 is an exploded view of the present invention.
Figure 3:
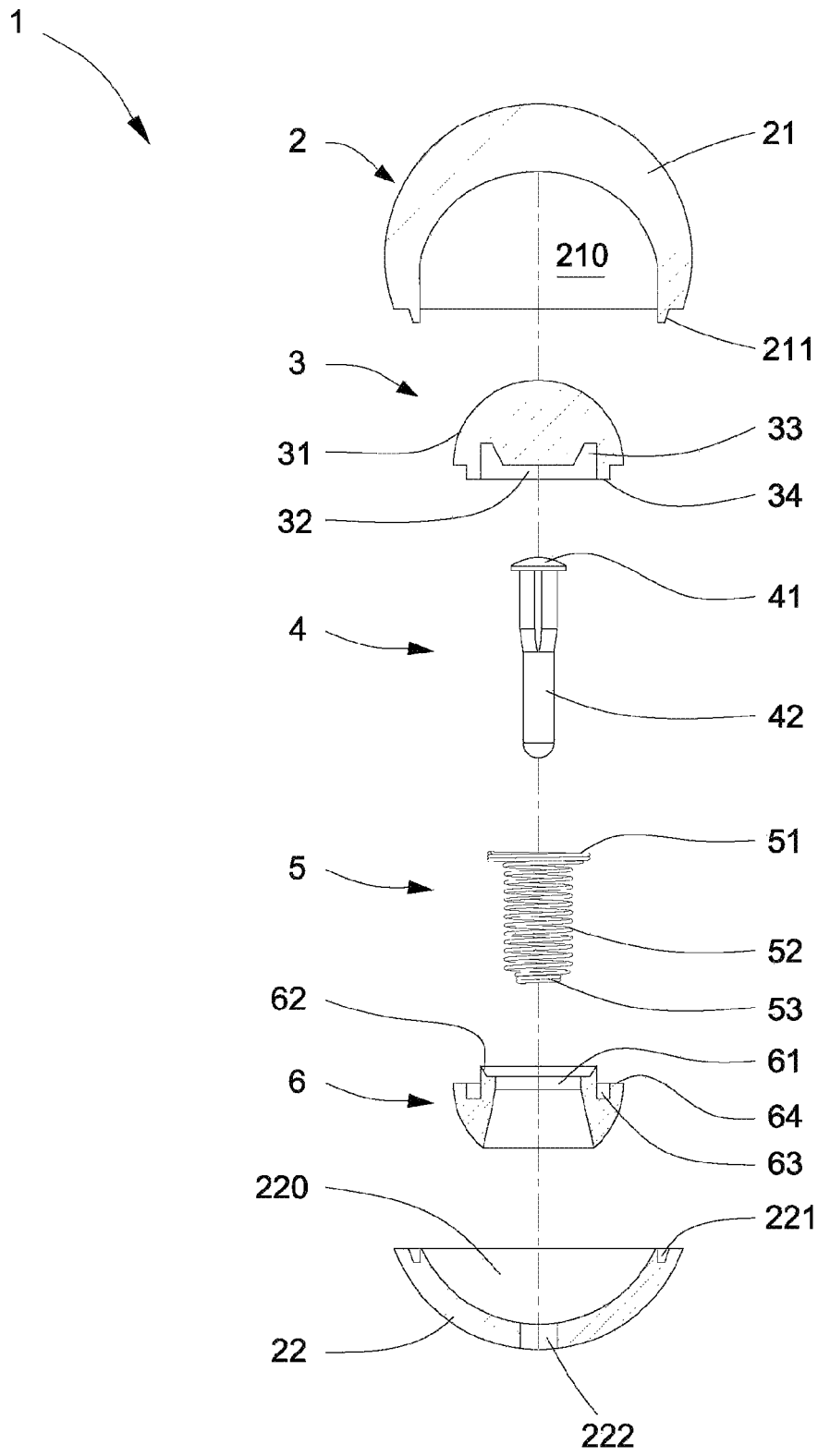
FIG. 3 is a sectional view of the present invention before being assembled.
Figure 4:
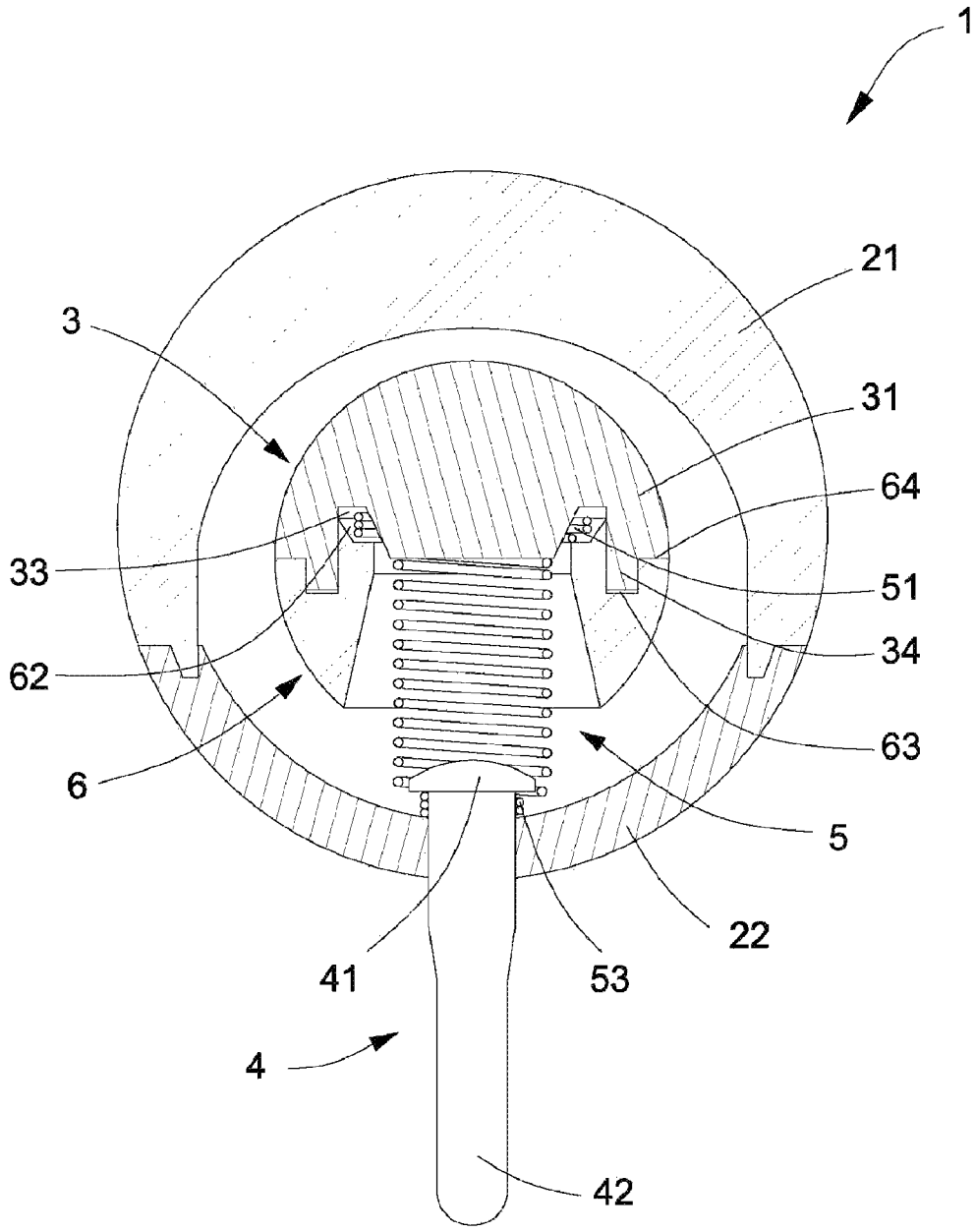
FIG. 4 is a sectional view of the present invention as assembled.

Now referring to FIGS. 2, 3, and 4, the rocking structure 1 is comprised of an outer casing 2, a first inner casing 3, a post 4, an elastic member 5, and a second inner casing 6.

The outer casing roughly in a hollow spherical form is comprised of a first outer casing 21 and a second out casing 22, made of fully or partially transparent material; a first space 210 provided with an externally raised loop 211 being disposed inside the first outer casing 21; a second space 220 provided with an externally recessed loop 221 to be coupled to the externally raised loop 221 being disposed in the second outer casing 22; and a through hole 222 being disposed at a center on a bottom of the second outer casing 22.

The first inner casing 3 roughly in a hemispherical form includes a hemispherical surface 31 to be printed thereon a pattern of an eyeball; an inner space 32 formed in the first inner casing 3; a recessed loop 33 disposed at where appropriately in the inner space 32; and a coupling loop 34 disposed on an outer circumference of the inner space 32.

The post 4 includes a head 41; a shank 42 extending from a bottom of the head 41; and an area of the bottom of the head 41 greater than a sectional area of the post 42.

The elastic member 5 related to a coil includes a top portion 51, a connection portion 52, and a lower portion 53 in different diameters; wherein the diameter of the top portion 51 is slightly greater than that of the connection portion 52; and the diameter of the connection portion 52 is slightly greater than that of the lower portion 53.

The second inner casing 6 also indicating a hemispherical form and coupled to the first inner casing 3 into an orb contains a space 61; a lower recessed loop 62 disposed at a top of a circumference of the space 61 in relation to the recessed loop 33 of the first inner casing 3; an inner locking loop 63 disposed at where appropriately in the second inner casing 6; a lower coupling loop 64 externally disposed to the inner locking loop 63; the inner locking loop 63 and the lower coupling loop 64 coupled to the upper coupling loop 34 of the first inner casing 3.

Accordingly, a bottom of the post 4 penetrates through the elastic member 5 and a center of the second inner casing 6, but the post 4 is secured in the elastic member since it is prevented from fully penetrating through the elastic member 5 due to that the area of the bottom of the head 41 from the post 4 is greater than that of the bottom portion 53 of the elastic member 5 for both of the post 4 and the elastic member 5 being overlapped on each other. The connection portion 52 and the lower portion 53 of the elastic member 5 passing through the second inner casing 6 penetrate through the space 61, but the top portion 51 for being made in greater diameter fails to pass the space 61 and instead is merely accommodated at top circumference of the lower recessed loop 62 before coupling the first inner casing 3 with the second inner casing 6. The upper recessed loop 33 is abutted to the lower recess loop 62 to trap the top portion 51 of the elastic member 5. Finally, the shank 42 of the post 4 has its bottom to pass the through hole 222 and both of the first outer casing 21 and the second outer casing 22 are coupled to each other as illustrated in FIG. 4.

Figure 5:
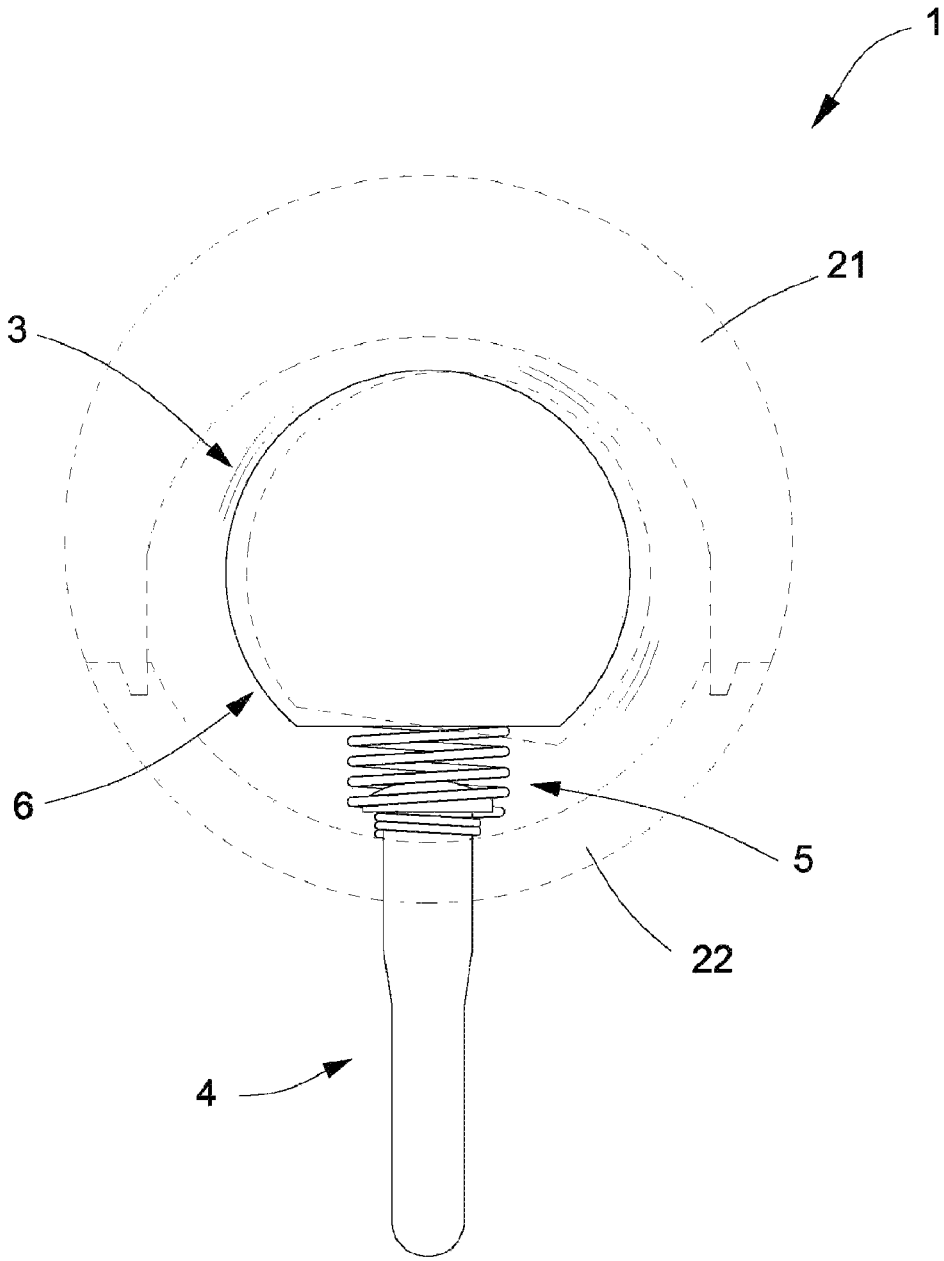
FIG. 5 is a schematic view showing an operating status of a local part of the present invention.
Figure 6:
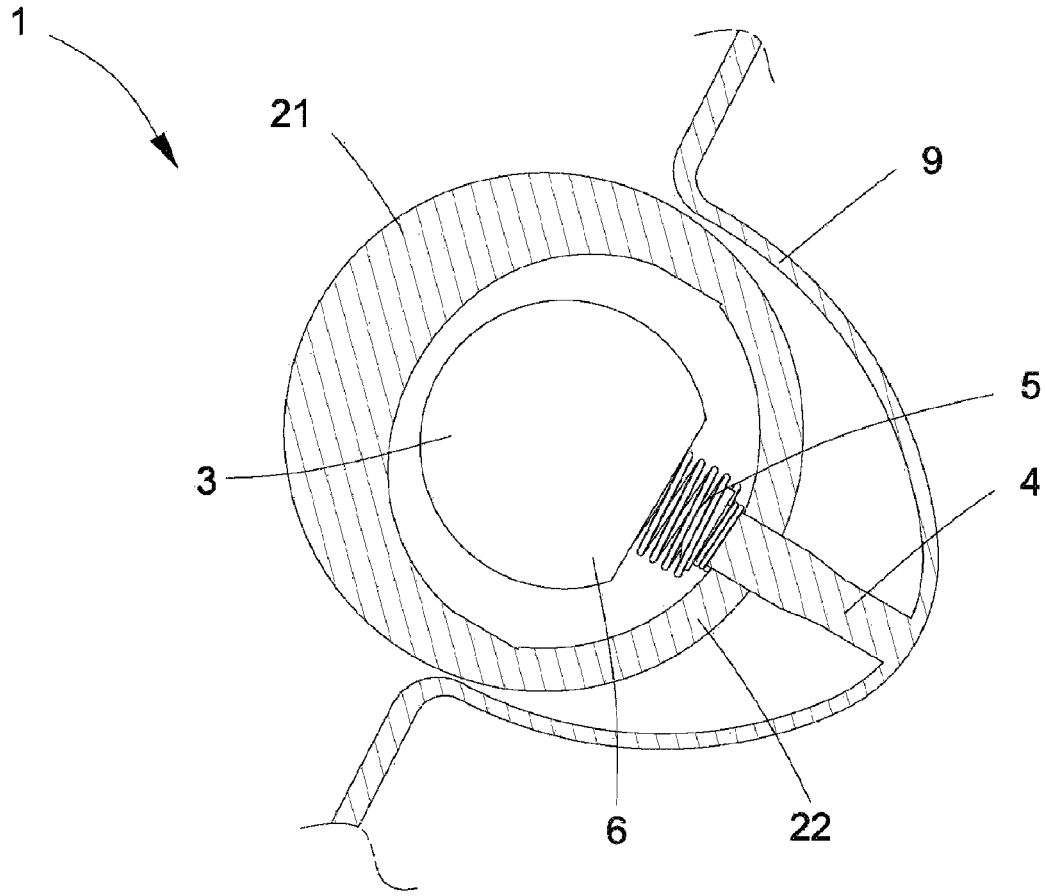
FIG. 6 is a sectional view showing a preferred embodiment of the present invention.
Figure 7:
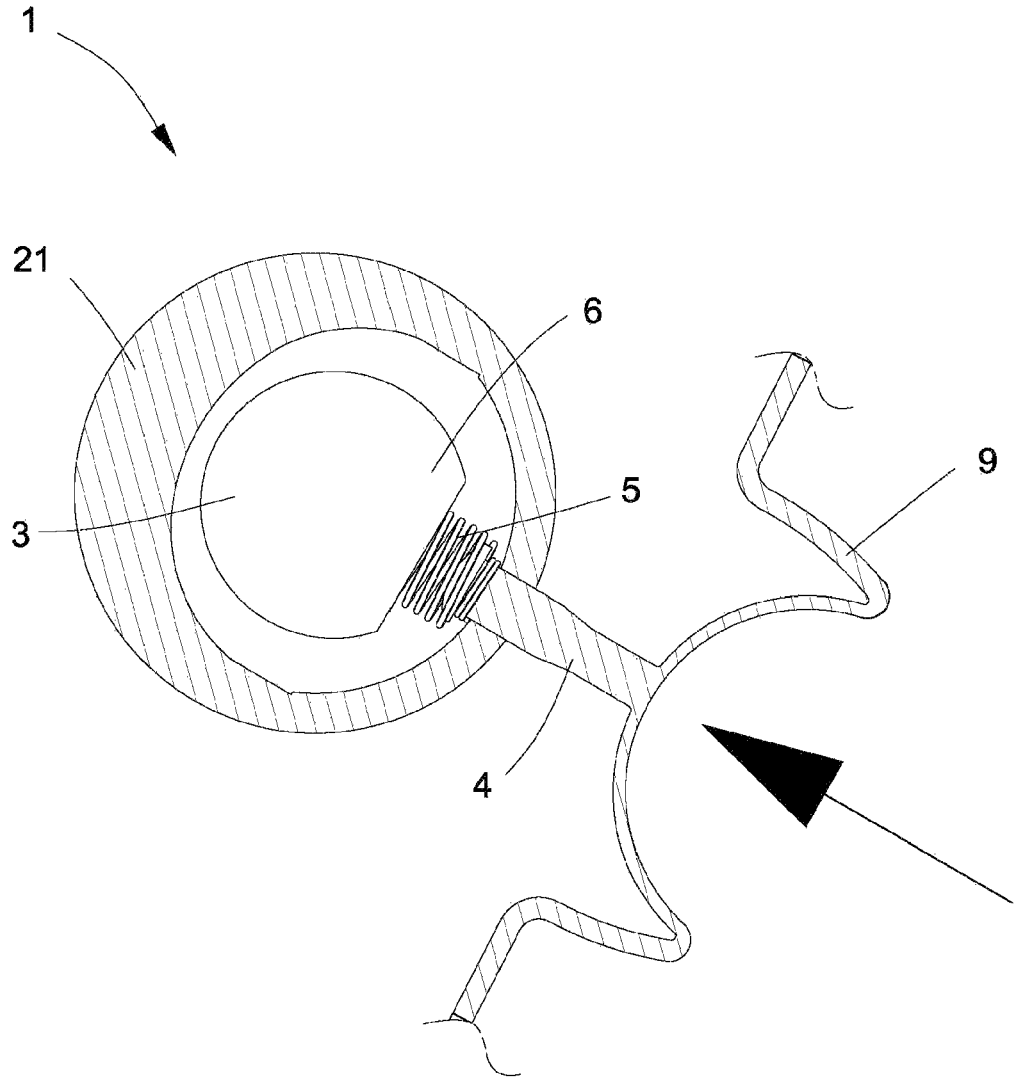
FIG. 7 is a sectional view showing an operating status of the preferred embodiment of the present invention.
Figure 8:
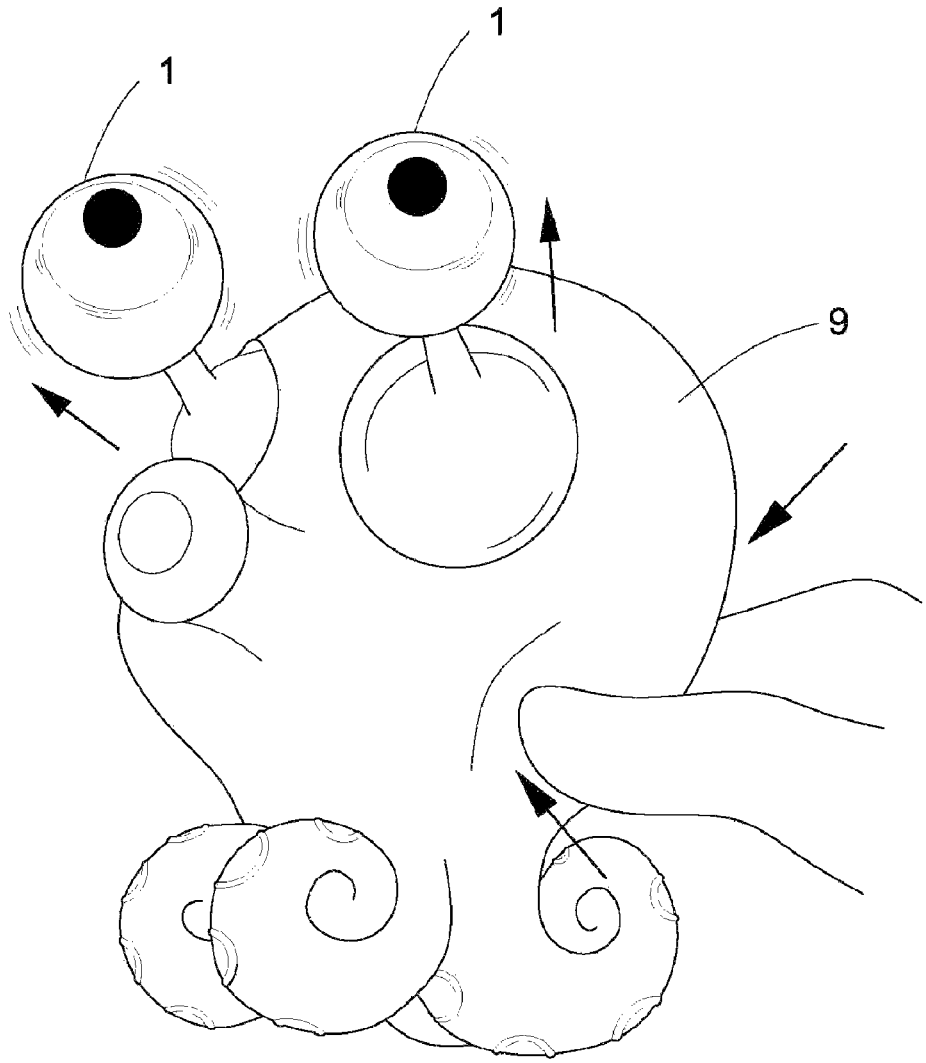
FIG. 8 is a perspective view showing an operating status of the present invention.

As illustrated in FIG. 5, whereas the first inner casing 3 and a second inner casing 6 are received in the outer casing 2 by means of the elastic member 5 in conjunction with the post 4, any mild external shaking could produce rocking kinetics for a certain length of time of the first inner casing 3 and the second inner casing 6 through the elastic member 5. Therefore, when the rocking structure of the present invention is applied in an eye of the puppet (as illustrated in FIGS. 1 and 6), the bottom of the post 4 is made an integral part with the puppet 9. If any air or fluid contained in the puppet 9 is squeezed, the rocking structure 1 otherwise in its reduced form pops up as illustrated in FIGS. 7 and 8 for the first inner casing 3 to maintain continuous rocking statue through the elastic member 5, and the eyeball printed on the first inner casing 3 will demonstrate bizarrely lovable rocking visual effects.

An optical structure comprised of a concave or a convex lens in different thicknesses may be provided at where appropriately on the first outer casing 21 so to magnify or reduce the pattern of the eyeball on the inner hemisphere 31 through refraction of the lenses.

I claim:

1. An internal rocking structure applied in eyeball of a puppet comprising: an outer casing, and an inner casing wherein a pattern of an eyeball is printed at where appropriately on the inner casing, and an elastic member, wherein the outer casing is hollowed to contain the inner casing and the elastic member, and the inner casing is connected to a bottom in the outer casing; wherein the outer casing in a slightly hollow spherical form comprises a first outer casing and a second outer casing; a first space disposed in the first outer casing; a second space disposed in the second outer casing; and a through hole disposed at a center of a bottom of the second outer casing; a first inner casing containing an inner space and an upper recessed loop being disposed appropriately in the inner space; a post including a head, a shank extending from a bottom of the head, and an area of the bottom of the head being greater than a sectional area of the shank, wherein the bottom of the post is coupling to the puppet as an integral part of the puppet; an elastic member related to a coil comprising a top portion, a connection portion, and a lower portion in different diameters; wherein a diameter of the top portion is greater than that of the connection portion; and a diameter of the connection portion is greater than that of the lower portion; a second inner casing is relatively coupled with the first inner casing; and the second casing contains a space and a lower recessed loop being disposed on a top of a circumference of the space in relation to the upper recessed loop; and means to producing continuously rocking kinetics for a certain length of time of the first inner casing and the second inner casing through the elastic member by a mild external shaking or squeezing of the puppet.

2. The internal rocking structure applied in eyeball of the puppet as claimed in claim 1, wherein the outer casing is made of a fully or partially transparent material.

3. The internal rocking structure applied in eyeball of the puppet as claimed in claim 1, wherein an outer protruding loop is disposed on a circumference of the first outer casing; an outer recessed loop is disposed to a circumference of the second outer casing; and the outer protruding loop is coupled to the outer recessed loop.

4. The internal rocking structure applied in eyeball of the puppet as claimed in claim 1, wherein the first inner casing includes a hemisphere where the pattern of eyeball to be printed on.

5. The internal rocking structure applied in eyeball of the puppet as claimed in claim 1, wherein an upper coupling loop is disposed on an outer circumference of the inner space of the first inner casing; an inner locking loop is disposed at where appropriately in the second inner casing; a lower coupling loop is disposed externally to the inner locking loop; and both of the inner locking loop and the lower coupling loop are relatively coupled to the upper coupling loop.

6. The internal rocking structure applied in eyeball of the puppet as claimed in claim 1, wherein an area of a bottom of the head is greater than that of the lower portion of the elastic member.

7. The internal rocking structure applied in eyeball of the puppet as claimed in claim 1, wherein the diameter of the top portion is greater than the space in the second inner casing.

8. The internal rocking structure applied in eyeball of the puppet as claimed in claim 1, wherein the upper recessed loop is abutted to the lower recessed loop to trap the top portion of the elastic member between both loops.

9. The internal rocking structure applied in eyeball of the puppet as claimed in claim 1, wherein an optical structure comprised of a concave or a convex lens in different thicknesses is provided at where appropriately on the first outer casing.

10. The internal rocking structure applied in eyeball of the puppet as claimed in claim 1, wherein the outer casing is made of a fully or partially transparent material.

* * * * *